US006173770B1

(12) United States Patent
Morrill

(10) Patent No.: US 6,173,770 B1
(45) Date of Patent: Jan. 16, 2001

(54) SHEAR RAM FOR RAM-TYPE BLOWOUT PREVENTER

(75) Inventor: Charles D. Morrill, Benjamin, TX (US)

(73) Assignee: Hydril Company, Houston, TX (US)

( * ) Notice: Under 35 U.S.C. 154(b), the term of this patent shall be extended for 0 days.

(21) Appl. No.: 09/196,875

(22) Filed: Nov. 20, 1998

Related U.S. Application Data

(60) Provisional application No. 60/079,402, filed on Mar. 26, 1998.

(51) Int. Cl.[7] ..... E21B 19/00

(52) U.S. Cl. ..... 166/85.4; 166/55

(58) Field of Search ..... 166/55, 55.1, 55.6, 166/85.4; 251/1.1; 83/54, 192, 193, 694; 30/92

(56) References Cited

U.S. PATENT DOCUMENTS

| | | | | |
|---|---|---|---|---|
| 1,875,673 | | 9/1932 | Stockstill . | |
| 3,561,526 | | 2/1971 | Williams et al. . | |
| 3,736,982 | * | 6/1973 | Vujasinovic | 166/55 |
| 3,817,326 | * | 6/1974 | Meynier, III | 166/55 |
| 4,043,389 | * | 8/1977 | Cobb | 166/55 |
| 4,240,503 | * | 12/1980 | Holt, Jr. et al. | 166/55 |
| 4,313,496 | * | 2/1982 | Childs et al. | 166/55 |
| 4,323,117 | * | 4/1982 | Pierce | 166/55 |
| 4,347,724 | * | 9/1982 | Brown et al. | 72/203 |
| 4,347,898 | * | 9/1982 | Jones | 166/55 |
| 4,537,250 | | 8/1985 | Troxell, Jr. . | |
| 4,540,046 | * | 9/1985 | Granger et al. | 166/55 |
| 4,646,825 | | 3/1987 | Van Winkle . | |
| 4,923,005 | * | 5/1990 | Laky et al. | 166/55 |
| 5,360,061 | | 11/1994 | Womble . | |
| 5,400,857 | | 3/1995 | Whitby et al. . | |
| 5,515,916 | | 5/1996 | Haley . | |

FOREIGN PATENT DOCUMENTS 1030494 7/1983 (SU) .

OTHER PUBLICATIONS

Product Information Bulletin, Schaffer, Inc., 2 pages.

* cited by examiner

*Primary Examiner*—Thomas B. Will
*Assistant Examiner*—Nathan Mammen
(74) *Attorney, Agent, or Firm*—Rosenthal & Osha L.L.P.

(57) ABSTRACT

A ram assembly for positioning in opposed cavities in a body of a blowout preventer having a vertical bore includes a first ram and a second ram. The first and second rams are movable in the cavities along a central guideway axis and between an open position to permit passage of a tubular member through the bore and a closed position to shear the tubular member. A first and a second shear member are mounted on the first and second rams, respectively. Each shear member has a pair of shearing portions disposed on opposite sides of a blade axis. Each shearing portion has a first cutting edge inclined to the blade axis at a first angle and a second cutting edge inclined to the first cutting edge at a second angle. The cutting edges are arranged to shear the tubular member, and the first and second angles are related such that the tubular member is constrained between the shearing portions as the cutting edges shear the tubular member.

8 Claims, 10 Drawing Sheets

| Pipe Description | | | Tensile Properties | | | | Impacts at 73°F (ft-b) |
|---|---|---|---|---|---|---|---|
| Size | Wall Thickness (inches) | Heat No. | Yield Strength (psi) | Tensile Strength (psi) | Elongation (%) | Reduction Of Area (%) | |
| 5 in. 19.5 lb/ft G-105 | 0.362 | A43840 | | | | | |
| 5 in. 19.5 lb/ft S-135 | 0.362 | A43328 | 164,700 | 182,600 | 16.9 | 71.2 | 88 |
| 5 in. | | M98-01 | 91,500 | 133,700 | 20.7 | 59.2 | 13 |
| 6 5/8 in. 27.7 lb/ft S-135 | 0.362 | U60351 | 166,300 | 188,200 | 15.1 | 61.7 | 69 |
| 6 5/8 in. 27.7 lb/ft S-135 | 0.362 | U43604 | 131,800 | 144,600 | 18.7 | 47.1 | 51 |
| 6 5/8 in. 34.0 lb/ft S-135 | | U60383 | 156,900 | 176,200 | 18.1 | 60.8 | 69 |

FIG. 6A

| Casing Description | | | Tensile Properties | | | | Impacts at 73°F (ft-b) |
|---|---|---|---|---|---|---|---|
| Size | Wall Thickness (inches) | Heat No. | Yield Strength (psi) | Tensile Strength (psi) | Elongation (%) | Reduction Of Area (%) | |
| 6 5/8 in. 70.5 lb/ft | 1.104 | M98-02 | 72,100 | 127,400 | 23.2 | 63.5 | 41 |
| 8 5/8 in. 49.0 lb/ft L-80 | 0.557 | 2459A | 92,700 | 117,200 | 23.6 | 68.2 | 92 |
| 9 7/8 in. 62.8 lb/ft Q-125 | 0.625 | M98-05 | 130,300 | 142,400 | 26.6 | 56.2 | 100 |
| 10 3/4 in. 55.5 lb/ft Q-125 | 0.495 | K10427 | 97,800 | 115,200 | 21.0 | 72.1 | 129 |
| 11 3/4 in. 65.0 lb/ft Q-125 | 0.534 | 86361 | 159,600 | 179,500 | 16.3 | 53.0 | 83 |
| 11 7/8 in. 71.8 lb/ft Q-125 | 0.582 | M98-04 | 135,300 | 147,000 | 30.0 | 58.8 | 102 |
| 13 3/8 in. 72.0 lb/ft L-80 | 0.514 | A43408 | 93,500 | 114,600 | 23.7 | 73.4 | 105 |
| 13 5/8 in. 88.2 lb/ft Q-125 | 0.625 | M98-03 | 143,800 | 157,000 | 30.4 | 51.0 | 71 |

FIG. 6B

| Pipe and Casing Description | | Operator Pressures (psi) |
|---|---|---|
| Size | Heat No. | Net Close |
| 5 inch 19.5 lb/ft S-135 | A43328 | 1489 |
| 6 5/8 inch 27.7 lb/ft S-135 | U60351 | 1476 |
| 8 5/8 inch 49.0 lb/ft L-80 | 2459A | 2227 |
| 13 3/8 inch 72.0 lb/ft L-80 | A43408 | 1858 |
| 6 5/8 inch 70.7 lb/ft | M98-02 | 2240 |
| 9 7/8 inch 62.8 lb/ft Q-125 | M98-05 | 2938 |
| 11 7/8 inch 71.8 lb/ft Q-125 | M98-04 | 2724 |
| 13 5/8 inch 88.2 lb/ft Q-125 | M98-03 | 2970 |
| 6 5/8 inch 27.7 lb/ft S-135 | U60351 | 1355 |
| 5 inch 19.5 lb/ft G-105 | A43840 | 1452 |
| 8 5/8 inch 49.0 lb/ft L-80 | 2459A | 1761 |
| 13 3/8 inch 72.0 lb/ft L-80 | A43408 | 1916 |
| | | 1901 |
| 11 3/4 in. 65.0 lb/ft Q-125 | 86361 | 2300 |
| | | 2284 |
| 10 3/4 in. 55.5 lb/ft L-80 | K10427 | 1710 |
| | | 1783 |

FIG. 7

| Pipe and Casing Description | | | | Number of Shears | Net Shear Pressure (psi) |
|---|---|---|---|---|---|
| Diameter | Weight | Grade | Wall Thickness (inches) | | |
| 13 5/8 inch | 88.2 lb/ft | Q-125 | 0.625 | 1 | 2970 |
| 13 3/8 inch | 72.0 lb/ft | L-80 | 0.514 | 3 | 1892 |
| 11 7/8 inch | 71.8 lb/ft | Q-125 | 0.584 | 1 | 2724 |
| 11 3/4 inch | 65.0 lb/ft | Q-125 | 0.532 | 2 | 2292 |
| 10 3/4 inch | 55.5 lb/ft | Q-125 | 0.495 | 2 | 1747 |
| 9 7/8 inch | 62.8 lb/ft | Q-125 | 0.625 | 1 | 2938 |
| 8 5/8 inch | 49.0 lb/ft | L-80 | 0.557 | 2 | 1994 |
| 6 5/8 inch | 70.5 lb/ft | | 1.104 | 1 | 2240 |
| 6 5/8 inch | 27.7 lb/ft | S-135 | 0.362 | 2 | 1416 |
| 5 inch | 19.5 lb/ft | S-135 | 0362 | 1 | 1489 |
| 5 inch | 19.5 lb/ft | G-105 | 0.362 | 1 | 1452 |

FIG. 8

SHEAR RAM FOR RAM-TYPE BLOWOUT PREVENTER

CROSS REFERENCE TO RELATED APPLICATIONS

This application claims priority from provisional application Ser. No. 60/079,402, filed on Mar. 26, 1998.

BACKGROUND OF THE INVENTION

1. Technical Field

The invention relates generally to blowout preventers and, more particularly, to a ram-type blowout preventer having shear rams for shearing a pipe, casing, or other oilfield tubular.

2. Background Art

During well drilling operations, fluid may flow into the well from subsurface formations adjacent the well. If the formation fluid influx is not properly controlled, the well may blow out. Thus, blowout preventers are usually installed at the wellhead to contain pressure in the wellbore and prevent the well from blowing out while the formation fluid influx is controlled. A ram-type blowout preventer has a bore that may be aligned with the well and a pair of opposed rams that may be actuated to engage each other and close off the bore. The rams may be shear rams which carry blades that can shear a pipe, casing, or other tubular that is suspended in the bore of the preventer. Typically, the pipe is sheared by moving the rams against the pipe to substantially flatten the pipe at the blade contact region. Further movement of the blades against the pipe then shears the flattened portion of the pipe.

In certain instances, such as when the diameter of the blowout preventer bore is much less than half of the circumference of the pipe, the length of the flattened-out portion of the pipe may interfere with further travel and shearing action of the rams. The flattened-out portion of the pipe may also wedge in the preventer bore such that removal of the pipe and control of the well is seriously impaired. Therefore, it is desirable to have a shear ram that will cleanly shear any diameter of pipe that can be run into the bore of the preventer. It is also desirable that the shear ram shears the pipe in a manner that will not impair pipe removal and well control procedures.

U.S. Pat. No. 5,400,857 to Whitby et al. discloses a ram assembly for positioning in a blowout preventer which includes opposing V-shaped blades that are arranged to constrain a tubular in the bore of the preventer prior to shearing the tubular. The V-shaped blades are moved radially inward to engage the tubular at four contact points and deform the tubular to a rectangular-shaped configuration. After deformation of the tubular, further movement of the blades against the tubular applies forces which creates stress fractures in the tubular. The stress fractures propagate to essentially result in brittle shearing of the tubular.

SUMMARY OF THE INVENTION

In general, in one aspect, a ram assembly for positioning in opposed cavities in the body of a blowout preventer having a vertical bore comprises a first and a second ram movable in the cavities along a central guideway axis and between an open position to permit passage of a tubular member through the bore and a closed position to shear the tubular member. A first and a second shear member are mounted on the first and second rams, respectively. Each shear member has a pair of shearing portions disposed on opposite sides of a blade axis. Each shearing portion has a first cutting edge inclined to the blade axis at a first angle and a second cutting edge inclined to the second cutting edge at a second angle. The cutting edges are arranged to shear the tubular member, and the first and second angles are related such that the tubular member is constrained between the shearing portions as the cutting edges shear the tubular member.

Other advantages of the invention will become apparent from the following description and from the appended claims.

BRIEF DESCRIPTION OF THE DRAWINGS

FIGS. 6A and 6B show data for pipe and casings sheared with the shear ram assembly of FIG. 1.

FIG. 7 shows ram operator pressures observed during shearing of the pipe and casings described in FIGS. 6A and 6B.

FIG. 8 shows shear pressures observed during shearing of the pipe and casings described in FIGS. 6A and 6B.

DETAILED DESCRIPTION

Figure 1:
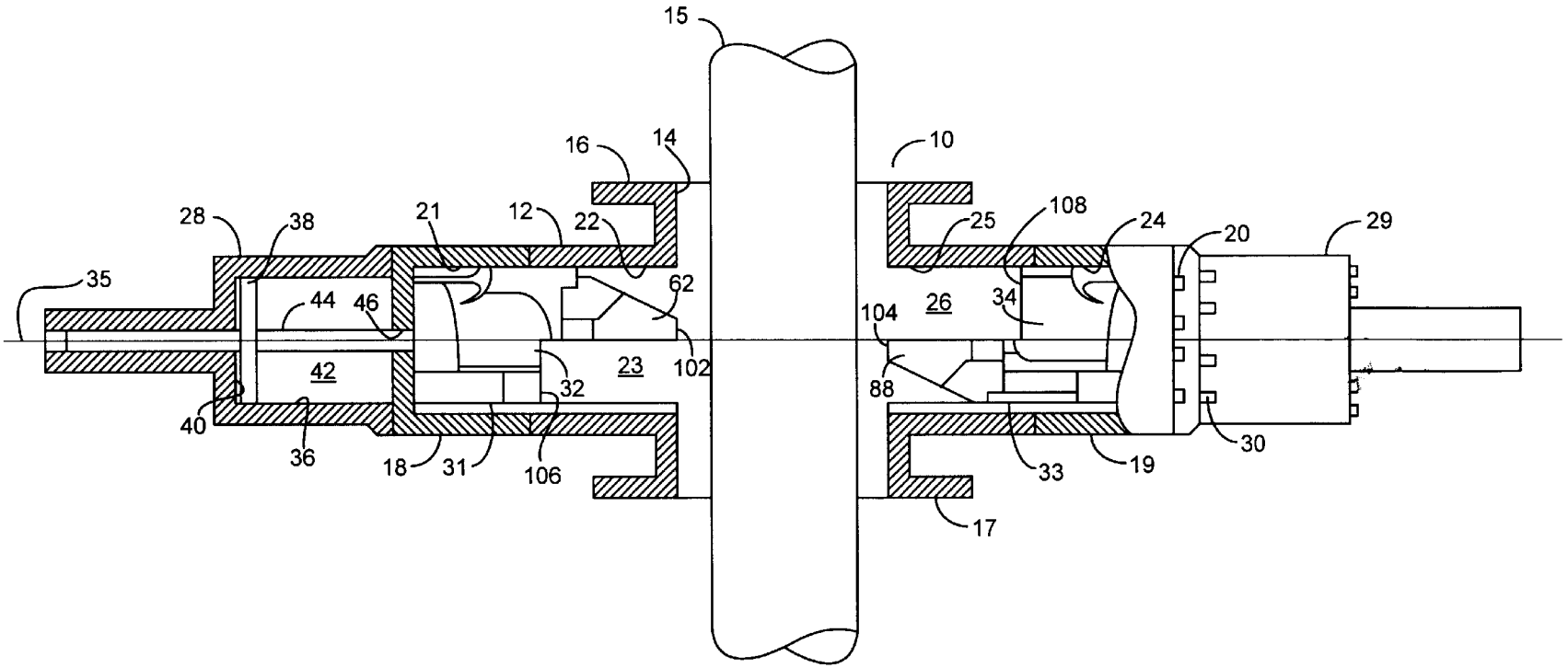
FIG. 1 is a schematic of a blowout preventer employing a shear ram assembly.

Referring to the drawings wherein like characters are used for like parts throughout the several views, FIG. 1 illustrates a blowout preventer 10 which includes a body 12 having a bore 14 extending vertically therethrough. A pipe 15 is suspended in the bore 14. The body 12 has flanges 16 and 17 that may be connected to wellhead equipment (not shown) in a manner well known in the art. Bonnets 18 and 19 are mounted on opposite ends of the body 12 by hinges (not shown) and secured to the body 12 by bolts 20. The inner wall 21 of the bonnet 18 and the inner wall 22 of the body 12 define a ram cavity 23, which extends laterally from the bore 14. The inner wall 24 of the bonnet 19 and the inner wall 25 of the body 12 define a ram cavity 26, which extends laterally from the bore 14 and is opposed to the ram cavity 23. The bolts 20 may be loosened and the bonnets 18 and 19 may be swung open to allow access to the ram cavities 23 and 26. Actuators 28 and 29 are attached to the bonnets 18 and 19, respectively, by bolts 30.

The blowout preventer 10 includes an upper carrier ram block 32 and a lower carrier ram block 34 which are positioned in the ram cavities 23 and 26, respectively. The ram blocks 32 and 34 are movable within the ram cavities 23 and 26, along a guideway axis 35. The ram blocks 32 and 34 carry shear blades which are arranged to shear the pipe 15 in the bore 14 of the preventer. The actuators 28 and 29 are provided to extend the ram blocks 32 and 34 toward the bore 14 to shear off a pipe or other tubular that is suspended in the bore 14. The actuators 28 and 29 may also be operated to retract the ram blocks 32 and 34 into the ram cavities 23 and 26, respectively, to open the bore 14 and allow passage of pipe or other tool joint through the bore 14. Guide rods 31 and 33 are provided to maintain a substantially linear motion of the ram blocks 32 and 34 when the bonnets 18 and 19 open and the cavity walls are are not available to guide the ram blocks.

The actuator 28 includes a cylinder 36 which slidably receives a piston 38. The closing side of the piston 38 is exposed to a first fluid chamber 40 and the opening side of the piston 38 is exposed to a second fluid chamber 42. Pressure differential between the fluid chambers 40 and 42 causes the piston 38 to reciprocate inside the cylinder 36. A rod 44, which extends through a hole 46 in the bonnet 18, connects the piston 38 to the ram block 32. In this way, the reciprocating movement of the piston 38 causes the ram block 32 to move toward or away from the bore 14. The actuator 29 connects to and operates the ram block 34 in the same manner just described for the actuator 28 and ram block 32.

Figure 2:
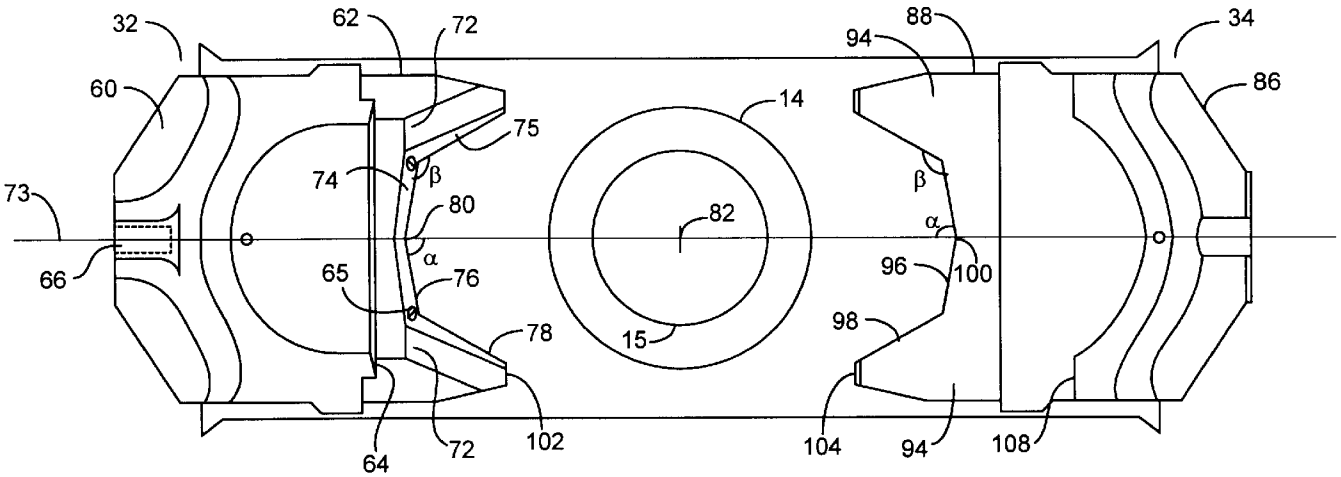
FIG. 2 is a top view of the shear rams of the ram assembly shown in FIG. 1.
Figure 3:
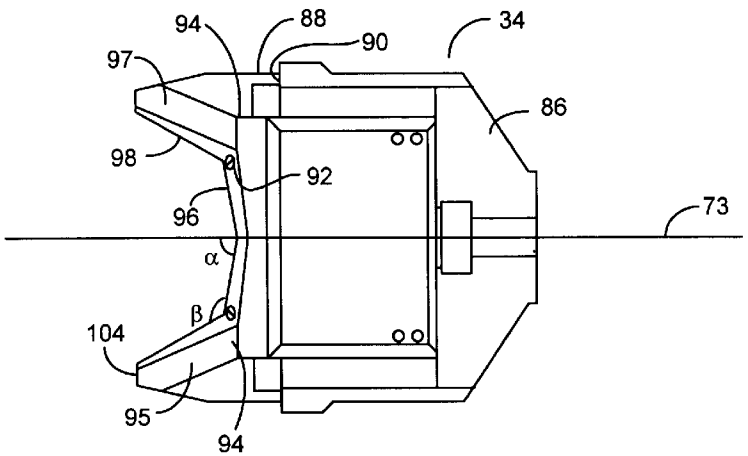
FIG. 3 is a bottom view of one of the shear rams shown in FIG. 2.

Referring to FIGS. 2 and 3, the ram block 32 includes a body 60 and a shear blade 62. The shear blade 62 is secured to the face 64 of the body 60 by bolts 65. The body 60 includes an opening 66 for receiving the rod 44, shown in FIG. 1. The shear blade 62 includes a pair of cutting portions 72 which are arranged on opposite sides of a blade axis 73. Each cutting portion 72 has beveled surfaces 74 and 75 and cutting edges 76 and 78. The beveled surfaces 74 and 75 provide clearance between the blade 62 and the wall defining the ram cavity 23 when opening the bonnet 18. The cutting edges 76 of the cutting portions 72 have a common vertex 80.

The ram block 34 includes a body 86 and a shear blade 88. The shear blade 88 is secured to the face 90 of the body 86 by bolts 92. The shear blade 88 includes a pair of cutting portions 94 which are arranged on opposite sides of the blade axis 73. Like the cutting portion 72, each cutting portion 94 has beveled surfaces 95 and 97 and cutting edges 96 and 98. The beveled surfaces 95 and 97 provide clearance between the blade 88 and the wall defining the ram cavity 26 when opening the bonnet 19. The cutting edges 96 and 98 have a common vertex 100. The blade axis 73 passes through the vertices 80 and 100 of the shear blades 62 and 88, respectively. The shear blades 62 and 88 may be made of any suitable tough, wear-resistant material, e.g., H13 steel with Rockwell C hardness of 44–48.

The ram blocks 32 and 34 are arranged in the ram cavities 23 and 26 in such a manner that the blade axis 73 is parallel or substantially parallel to the guideway axis 35, shown in FIG. 1. The cutting edges 76 and 96 of the shear members 62 and 88, respectively, are arranged to first engage the pipe 15 in the bore 14 and present a crush and shear action on the pipe, much like a scissors cutting a tube. Then, the cutting edges 78 and 98 may contact the pipe and present a slice and shear action on the pipe, much like a knife cutting a tube. The shear blades 62 and 88 are positioned on the ram blocks 32 and 34, respectively, such that the shear blades 62 just slides over the shear blade 88 as the ram blocks 32 and 34 move toward the center of the bore 14. The faces 106 and 108 of the ram blocks 32 and 34, respectively, act as stoppers for the traveling blades 62 and 88.

The cutting edges 76 and 96 are inclined at angles $\alpha$ to the blade axis 73. The cutting edges 78 and 98 are inclined at angles $\beta$ to the cutting edges 76 and 96, respectively. Each angle $\alpha$ is preferably much greater than 45° and less than 90°. Each angle $\beta$ is preferably less than 180°. The angles $\alpha$ and $\beta$ and the length of the cutting edges 76, 78, 96, and 98 should be selected such that a pipe suspended in the bore 14 is constrained between the cutting edges 78 and 98 during a shearing action by the shear blades 62 and 88. This ensures that the sheared pipe does not extend out to wedge in the bore 14.

In operation, and with reference to FIGS. 1–5, hydraulic fluid is supplied to the first chamber 40 of the cylinder 36 at a pressure greater than the pressure of the fluid in the second chamber 42. This causes the piston to move to the right, toward the bore 14. As the piston 38 moves to the right, fluid is exhausted from the chamber 42. The motion of the piston 38 pushes the rod 44 and the ram block 32 toward the bore 14 and along the guideway axis 35. At the same time that the ram block 32 is moving toward the bore 14, the ram block 34, which is actuated by the actuator 29, is also moving toward the bore 14.

Figure 4:
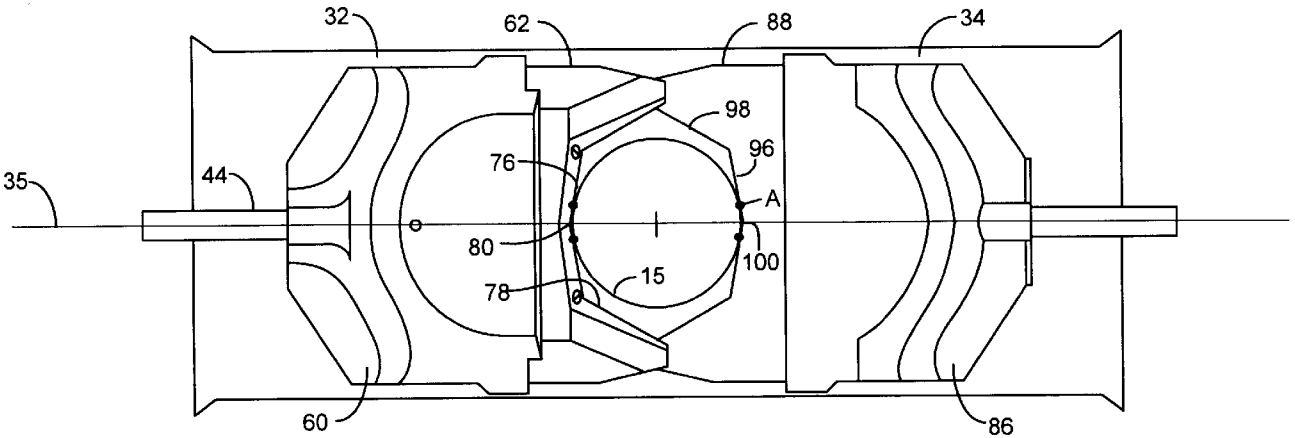
FIGS. 4 and 5 illustrate the steps of shearing a pipe suspended in the bore of a blowout preventer using the shear rams shown in FIG. 2.
Figure 5:
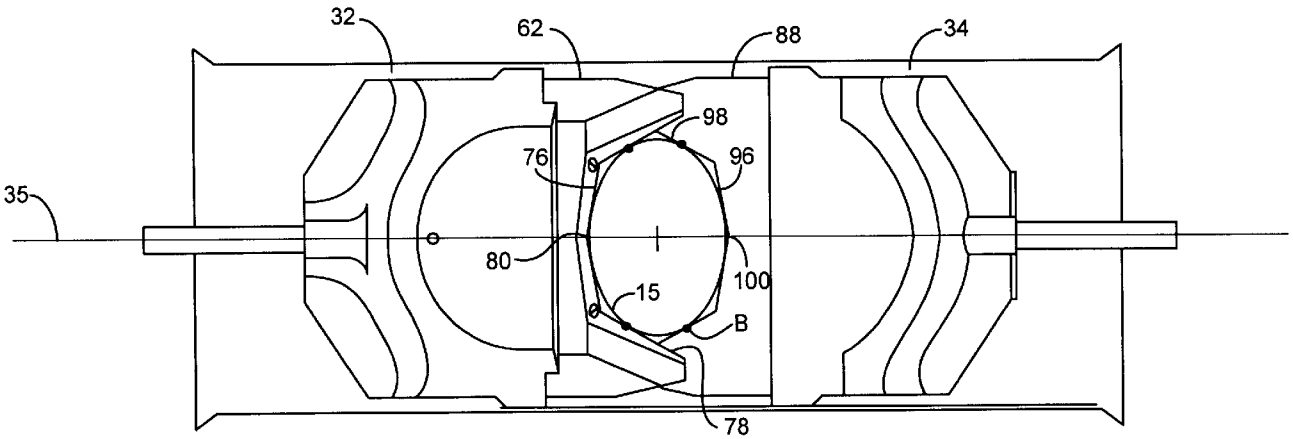

The cutting edges 76 and 96 first contact the pipe 15 at contact points A, as shown in FIG. 4. As the ram blocks 32 and 34 are further moved toward each other, the cutting edges 76 and 96 crush and shear the pipe 15 while flattening or deforming the pipe 15 to an oval shape at the blade contact region, as shown in FIG. 5. As the pipe 15 is ovaled, the cutting edges 78 and 98 constrain the pipe such that the ovaled pipe does not extend out and wedge in the bore. The cutting edges 78 and 98 engage the ovaled pipe at contact points B and start to slice and shear the pipe. The cutting edges work cooperatively to completely shear the pipe 15 by the time the face 102 of the shear blade 62 reaches the face 108 of the ram block 34 and the face 104 of the shear blade 88 reaches the face 106 (see FIG. 1) of the ram block 32.

FIG. 4 shows the shear blades 62 and 88 overlapping when the cutting edges 76 and 96 first contact the pipe 15. For a larger pipe diameter, the shear blades 62 and 88 may not overlap when the cutting edges 76 and 96 first contact the pipe. However, the shear blades should overlap as the pipe is ovaled and by the time the cutting edges 78 and 98 contact the ovaled pipe. In this way, the ovaled pipe is constrained between the cutting edges 78 and 98 and does not extend out to wedge in the bore of the preventer. The crush and shear action of the cutting edges 76 and 96 reduces the force required by the cutting edges 78 and 98 to slice and shear the pipe. The cutting edges 76, 78, 96, and 98 contact the pipe at eight points, allowing for an efficient and quick shearing of the pipe. The slice and shear action of the blades 78 and 98 is particularly useful for pipes with high ductility.

After shearing the pipe 15, the upper portion of the sheared pipe may be removed from the blowout preventer 10. Normally, an engaging member positioned below the blowout preventer 10 would hold the lower portion of the sheared pipe. The engaging member may be a blowout preventer with pipe rams that may be actuated to sealingly engage a pipe suspended in its bore. The ovaled end of the lower portion of the sheared pipe makes it possible to communicate fluid to a well below the blowout preventer and carry out well control procedures without removing the pipe from the blowout preventer. When desired, the lower portion of the sheared pipe may be removed from the blowout preventer in a conventional manner, e.g., using an overshot.

To open the bore 14 after a shearing action, hydraulic fluid is supplied to the second chamber 42 of the cylinder 36 at a pressure greater than the pressure in the first chamber 40. This causes the piston 38 to move to the left, away from the bore 14. As the piston 38 moves to the left, fluid is exhausted from the chamber 40. The piston motion causes the rod 44 and the ram block 32 to move away from the bore 14. At the same time that the ram block 32 is moving away from the bore 14, the actuator 29 may also be operated to move the ram block 34 away from the bore 14 in the same manner just described for the ram block 32.

The invention has many advantages. First, when the shear blades 62 and 88 shear a pipe, or casing, the sheared ends of the pipe are ovaled. The ovaled end of the pipe makes it possible to communicate with the wellbore to perform wellbore control operations. The ovaled end of the pipe also makes it possible to use a stabbing tool to pick up and recover the sheared pipe. Second, the shear blades 62 and 88 shear the pipe in a manner which does not damage the blowout preventer, i.e., the sheared pipe does not extend out to wedge in the bore of the preventer. Third, the shear blades 62 and 88 have a configuration which permits a crushing and shearing actions on a pipe. This makes it possible to shear tough and highly ductile pipes and casings. The shear blades 62 and 88 also contact a pipe, or casing, at eight contact points to facilitate the shearing operation.

The ram blocks 32 and 34 have been tested on the pipes and casings described in FIGS. 6A and 6B in accordance with American Petroleum Institute Specification 16A. For the tests, the ram blocks 32 and 34 were sized to fit in the cavity of a Hydril™ ram blowout preventer having a bore diameter of 18¾ inches and a pressure rating of 15,000 psi. The tests were run using ram operators (or actuators) with 3,000 psi accumulator pressure as the normal closing force. The shear blades 62 and 88 of the ram blocks 32 and 34 sheared pipes having diameters ranging from 5 to 6⅝ inches and casings having diameters ranging from 6⅝ inches to 13⅝ inches.

The observed net close pressure for each shear test in the order of testing is summarized in FIG. 7. The net close pressure is defined as the net closing force at time of shearing divided by the closing piston area. The net closing force is equal to the difference between the force on the closing side of the piston and the force on the opening side of the piston at the time of shearing.

The net shear pressures, or average net closing pressures of the operators, observed during the shear tests as well as the number of shears performed for each pipe or casing are listed in FIG. 8. For the largest casing, i.e., 13⅝-inch, 88.2-lb/ft, Q-125 casing, sheared during the testing, the net shear pressure recorded is 2,970 psi. The diameter of this casing is 0.73 times, much over half, the diameter of the preventer bore. Two sets of shear blades and one set of ram blocks were used for all testing. The blades were examined periodically during the test series and deburred as necessary. The blade attachments bolts were also checked for proper torque and re-tightened as necessary. Magnetic particle inspection of the rams and shear blades after all testing showed no cracks.

Figure 9:
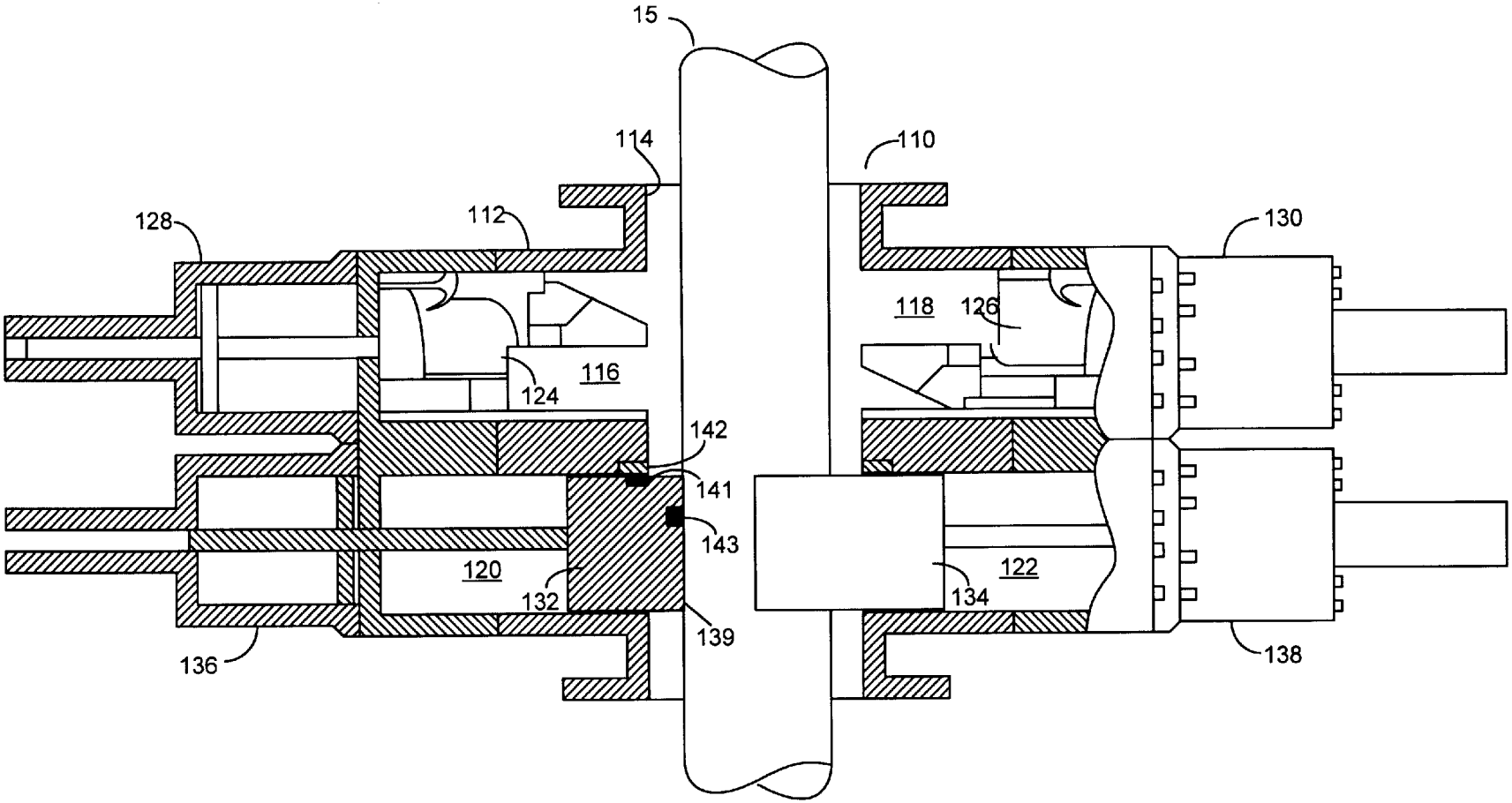
FIG. 9 is a schematic of a dual ram blowout preventer employing the shear rams shown in FIG. 2.

Referring now to FIG. 9, a dual ram blowout preventer 110 having a first set of ram members for sealing against a pipe and a second set of ram members for shearing a pipe is shown. The dual ram blowout preventer 110 has a body 112 with a bore 114 running therethrough. The body 112 is also provided with upper cavities 116 and 118 and lower cavities 120 and 122. Ram blocks 124 and 126 are positioned in the upper cavities 116 and 118, respectively. The ram blocks 124 and 126 are similar to the ram blocks 32 and 34 shown in FIGS. 1–5. Actuators 128 and 130 are provided to move the ram blocks 122 and 124 toward and away from the bore 114.

Pipe rams 132 and 134 are movably positioned in the lower cavities 120 and 122. Actuators 136 and 138 are provided to move the rams 132 and 134 toward and away from the bore 114. As shown, the pipe rams 132 and 134 engage each other to define a bore 139 for receiving and engaging a pipe 140 in the bore 114. The pipe rams 132 and 134 include seals 141 for sealing against the seal seat 142 and seals 143 for sealing against the pipe 15, allowing fluid to be contained below the pipe rams 132 and 134. The pipe rams 132 and 134 may be retracted into the cavities 120 and 122, respectively, to allow the pipe 140 to be lowered or pulled through the bore 114 and to permit fluid to flow through the bore 114.

A shearing operation with the blowout preventer 110 involves actuating the pipe rams 132 and 134 to sealing engage the pipe 15 which is suspended in the bore 114. The ram blocks 124 and 126 are then actuated to move into the bore 114 and shear the pipe in the bore 114. The pipe rams 124 and 126 retain the lower portion of the sheared pipe in the bore. The lower portion of the sheared pipe may be released by retracting the pipe rams 132 and 134 into their respective cavities.

The invention has been described with respect to a limited number of embodiments. However, those skilled in the art will appreciate numerous variations therefrom without departing from the spirit and scope of the invention. For example, the cutting edges 76 and 96 of the shear blades 62 and 88, shown in FIGS. 2 and 3, are shown as culminating in pointed vertices 80 and 100. However, the vertices 80 and 100 may also be rounded. The ram blocks may also be equipped with sealing members so as to allow them to seal the preventer bore after a shearing action.

Figure 10A:
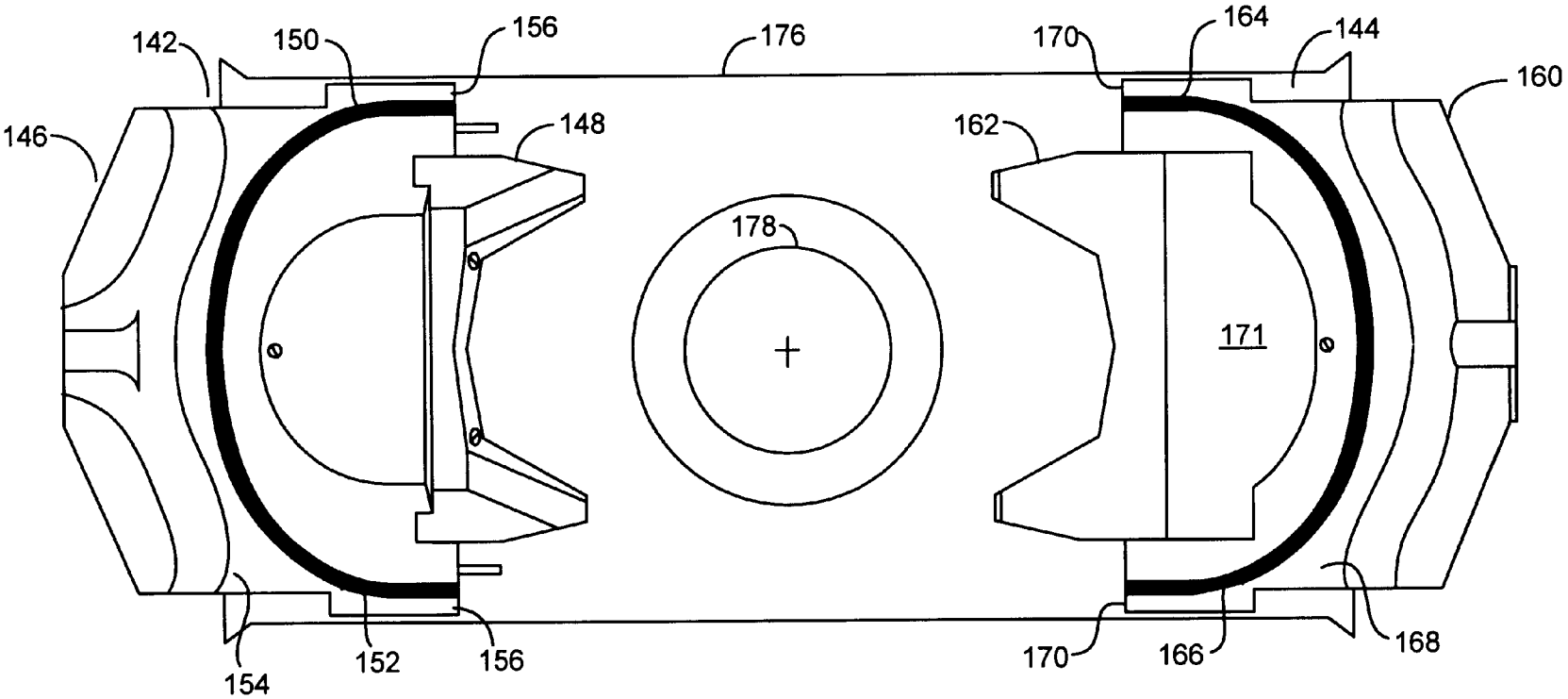
FIGS. 10A and 10B are top views of a sealing ram assembly in the non-sealing and sealing position, respectively.

Referring to FIG. 10A, a sealing upper carrier ram block 142 and a sealing lower carrier ram block 142 are shown. The ram block 142 includes a body 146 and a shear blade 148. The shear blade 148 is similar to the shear blade 62, shown in FIG. 2. The body 146 includes a seal member 150 that is positioned in a groove 152 that runs across the top surface 154 and the front surfaces 156 of the body 146. The ram block 144 includes a body 160 and a shear blade 162. The shear blade 162 is similar to the shear blade 88, shown in FIGS. 2 and 3. The body 160 includes a seal member 164 that is positioned in a groove 166 that runs across the top surface 168 and the front surfaces 170 of the body 160. The body 146 has a cavity (not shown) on its underside for receiving the shear blade 162. The body 160 has a cavity 171 for receiving the shear blade 148.

Figure 10B:
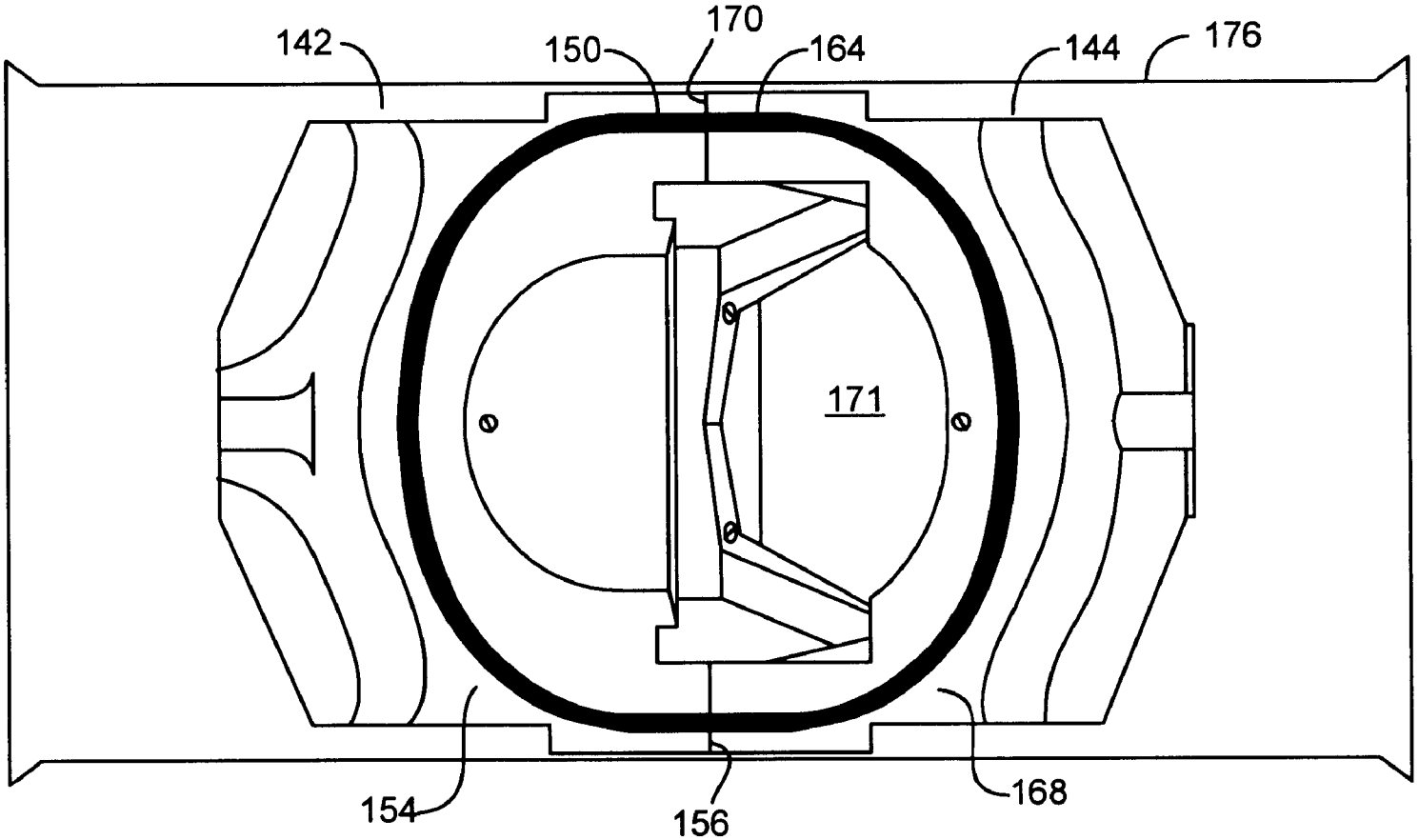
Figure 11:
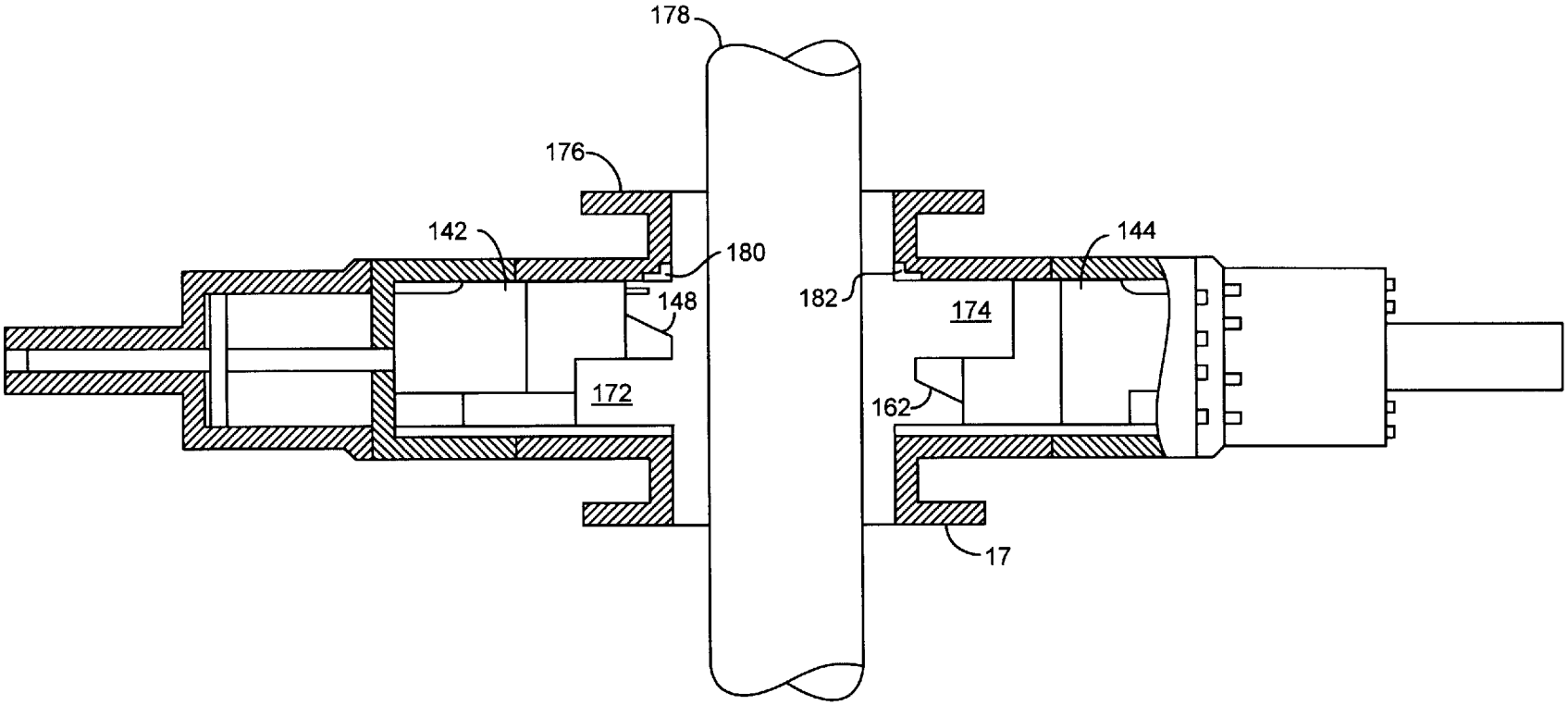
FIG. 11 is a schematic of a blowout preventer employing the sealing ram assembly of FIGS. 10A and 10B.

In operation, the ram blocks 142 and 144 are arranged in ram cavities 172 and 174 of a blowout preventer 176 as shown in FIG. 11. The ram blocks 142 and 144 are positioned to shear a pipe 178 that is suspended in the bore of the preventer. As previously described, the pipe is sheared by using actuators or ram operators to move the ram blocks 142 and 144 toward the pipe such that the shear blades 148 and 162 engage and shear the pipe. After shearing the pipe, the ram blocks may be operated to close off the bore of the preventer. This is accomplished by using the ram operators to move the shear blade 148 into the cavity 171 and the shear blade 162 into a cavity in the body 146, as shown in FIG. 10B. When the shear blades 148 and 162 are received in their respective cavities, the portions of the seal members 150 and 164 on the front faces 156 and 170 contact and seal against each other. The portions of the seal members 150 and 164 on the top surfaces 154 and 168 seal against seal seats 180 and 182 (shown in FIG. 11) on the body of the preventer 176.

The seal members 150 and 164 make it possible to contain fluid below the ram blocks 142 and 144. In order to provide the ram blocks 142 and 144 with sealing members, the bodies 146 and 160 has to be made considerably larger, i.e., larger than the non-sealing ram blocks. As such the ram blocks 142 and 144 may not fit into standard ram cavities and may require custom ram cavities.

For illustrative purposes, the ram blocks 32 and 34 are shown as positioned in ram cavities 23 and 26 of the blowout preventer 10. However, it should be clear that the ram blocks 32 and 34 may be suitably sized to fit into any standard cavity in a blowout preventer. This allows the ram blocks 32 and 34 to be easily integrated into existing blowout preventer stacks without modifying the ram cavities of the blowout preventer. When the ram blocks 32 and 34 are positioned in a blowout preventer with seal seats, such as seal seats 180 and 182 of FIG. 11, the seal seats provide support to the ram blocks so that the shear blades do not flop around in the blowout preventer during a shearing action. However, it is possible that the ram blocks may be out of the seal seats such that adequate support is not provided to the ram blocks. This may happen, for example, when the ram blocks are shearing a very large diameter pipe. Thus, to ensure that the ram blocks are adequately supported at all times, the standard seal seats may be removed and the blowout preventer may be provided with custom seal seats.

What is claimed is:

1. A ram assembly for positioning in opposed cavities in a body of a blowout preventer having a vertical bore, comprising:

a first and a second ram movable in the cavities along a central guideway axis and between an open position to permit passage of a tubular member through the bore and a closed position to shear the tubular member; and a first and a second shear member mounted on the first and second rams, respectively, each shear member having a pair of shearing portions disposed on opposite sides of a blade axis, each shearing portion having a first cutting edge inclined to the blade axis at a first angle and a second cutting edge inclined to the first cutting edge at a second angle the first angle being greater than 45 degrees but less than 90 degrees, the second angle being less than 180 degrees;

wherein the cutting edges are arranged to shear the tubular member, and the first and second angles and the lengths of the first and second cutting edges are related such that the tubular member is constrained between the shearing portions as the cutting edges shear the tubular member.

2. The ram assembly of claim 1, wherein the blade axis is substantially parallel to the guideway axis.

3. The ram assembly of claim 2, wherein the cutting edges of the first shear member is positioned to pass just below the cutting edges of the second shear member when the rams approach each other and the shear members shear the tubular member.

4. The ram assembly of claim 2, wherein the first cutting edges contact the tubular member before the second cutting edges contact the tubular member.

5. The ram assembly of claim 1, further comprising seal members positioned on each ram, the seal members being adapted to engage each other and the body of the blowout preventer when the rams are in the closed position.

6. A ram blowout preventer, comprising:

a body provided with a central bore and a pair of opposed cavities extending outwardly from the bore;

a ram assembly comprising:

a first and a second ram movable in the cavities along a central guideway axis and between an open position to permit passage of a tubular member through the central bore and a closed position to shear the tubular member; and a first and a second shear member mounted on the first and second rams, respectively, each shear member having a pair of shearing portions disposed on opposite sides of a blade axis, each shearing portion having a first cutting edge inclined to the blade axis at a first angle and a second cutting edge inclined to the first cutting edge at a second angle, the first angle being greater than 45 degrees but less than 90 degrees, the second angle being less than 180 degrees;

and a pair of ram operators for moving the first and second rams between the open and closed positions;

wherein the cutting edges are arranged to shear the tubular member, and the first and second angles and the lengths of the first and second cutting edges are related such that the tubular member is constrained between the shearing portions as the cutting edges shear the tubular member.

7. The ram blowout preventer of claim 6, further comprising a third and a fourth ram in opposed relation, the third and fourth rams being configured to move between a first position to sealingly engage each other and the tubular member and second position to permit the tubular member to pass through the central bore.

8. The ram blowout preventer of claim 6, wherein the first cutting edges contact the tubular member before the second cutting edges contact the tubular member.

* * * * *